US008187474B2

(12) United States Patent
Freeman et al.

(10) Patent No.: US 8,187,474 B2
(45) Date of Patent: May 29, 2012

(54) WATER-FILTERING MEDIA AND FILTERS

(75) Inventors: Mark C. Freeman, Channelview, TX (US); Jon J. Freeman, Channelview, TX (US); Clarence S. Freeman, Channelview, TX (US)

(73) Assignees: Mark C. Freeman, Channelview, TX (US); Jon J. Freeman, Channelview, TX (US); Clarence S. Freeman, Channelview, TX (US)

( * ) Notice: Subject to any disclaimer, the term of this patent is extended or adjusted under 35 U.S.C. 154(b) by 58 days.

(21) Appl. No.: 12/192,835

(22) Filed: Aug. 15, 2008

(65) Prior Publication Data

US 2009/0026149 A1 Jan. 29, 2009

Related U.S. Application Data

(63) Continuation of application No. 11/072,043, filed on Mar. 3, 2005, now Pat. No. 7,425,266.

(60) Provisional application No. 60/550,126, filed on Mar. 4, 2004.

(51) Int. Cl.

| | |
|---|---|
| ***B01D 37/00*** | (2006.01) |
| ***B01D 24/00*** | (2006.01) |
| ***C02F 1/00*** | (2006.01) |
| ***C02F 9/00*** | (2006.01) |
| *B01D 27/00* | (2006.01) |

(52) U.S. Cl. ..... 210/767; 210/195.1; 210/258; 210/295; 210/493.1; 210/500.1

(58) Field of Classification Search ..... 428/34.1; 210/487–489, 493.1, 500.1, 500.35, 500.42, 210/500.27, 321.6, 323.1, 640, 651, 195.1, 210/767, 258, 295; 429/33

See application file for complete search history.

(56) References Cited

U.S. PATENT DOCUMENTS

| | | | | |
|---|---|---|---|---|
| 4,250,029 | A * | 2/1981 | Kiser et al. | 210/652 |
| 4,255,148 | A * | 3/1981 | Reinwald et al. | 8/137 |
| 4,696,720 | A * | 9/1987 | Kiser | 203/19 |
| 4,780,211 | A * | 10/1988 | Lien | 210/644 |
| 4,868,346 | A * | 9/1989 | Kiser | 568/916 |
| 4,885,077 | A * | 12/1989 | Karakelle et al. | 204/403.06 |
| 5,266,391 | A * | 11/1993 | Donato et al. | 428/220 |
| 5,745,496 | A * | 4/1998 | Lysejko | 370/515 |
| 5,795,496 | A | 8/1998 | Yen et al. | |
| 5,906,748 | A * | 5/1999 | Kansa et al. | 210/640 |
| 6,517,725 | B2 * | 2/2003 | Spearman et al. | 210/640 |
| 6,994,742 | B2 * | 2/2006 | Barris et al. | 55/487 |

(Continued)

FOREIGN PATENT DOCUMENTS

DE 19936992 A1 5/2000

(Continued)

OTHER PUBLICATIONS

EPO Application Serial No. 05724413.9 Search Report dated Sep. 9, 2009.

Polish Patent Application Serial No. P-382303 First Office Action (Undated).

*Primary Examiner* — Ana Fortuna

(74) *Attorney, Agent, or Firm* — Conley Rose, P.C.

(57) ABSTRACT

In at least some embodiments, a system for removing contaminants from fluids includes a fluid inlet and a fluid outlet. The system also includes a fluid pump between the fluid inlet and the fluid outlet and a filter material between the fluid inlet and the fluid outlet. The filter material comprises a dual-valence polymer with negative valence monomer groups and positive valence monomer groups, the negative valence being stronger than the positive valence.

19 Claims, 7 Drawing Sheets

U.S. PATENT DOCUMENTS

| | | | | |
|---|---|---|---|---|
| 7,258,904 | B2 * | 8/2007 | Watanabe et al. | 428/34.1 |
| 7,371,321 | B1 * | 5/2008 | Nesland, Sr. | 210/248 |
| 7,425,266 | B2 * | 9/2008 | Freeman et al. | 210/493.1 |
| 2002/0077011 | A1 | 6/2002 | Blanch et al. | |

FOREIGN PATENT DOCUMENTS

| | | | |
|---|---|---|---|
| EP | 0941760 | A1 | 9/1999 |
| EP | 1166860 | A2 | 1/2002 |
| GB | 2333737 | A | 8/1999 |

* cited by examiner

BEFORE FILTERING

AFTER FILTERING

700

WATER-FILTERING MEDIA AND FILTERS

CROSS-REFERENCE TO RELATED APPLICATIONS

This application is a continuation of U.S. application Ser. No. 11/072,043, entitled "Water-Filtering Media and Filters", filed Mar. 3, 2005 now U.S. Pat. No. 7,425,266, which claims the benefit of Provisional Application No. 60/550,126, entitled "Filter/Monitor Able To Remove Water From Alcohol Blended Hydrocarbon Fuels And To Detect Commencement Of Phase Separation Of Alcohol," filed on Mar. 4, 2004, all of which are hereby incorporated herein by reference.

BACKGROUND

In the gasoline and diesel-fuel industry, the quality of fuel being dispensed is of great importance. To assure that only clean fuel is dispensed into a customer's vehicle, filters may be positioned in the flow stream of fuel dispensers to remove dirt and solid particulates from the gasoline or diesel being dispensed. Also, water has been recognized as harmful to vehicle engines. For example, truck engines and auto engines that implement fuel injector systems are sensitive to water.

In recent years, alcohols such as Methyl Tertiary Butyl Ether (MTBE) and Ethyl alcohol (i.e., Ethanol) have been blended into gasoline to act as an oxygenate to reduce the amount of semi-combusted hydrocarbons that are discharged into the atmosphere by motor vehicles. However, several problems are created by blending alcohols with gasoline and diesel fuel. For example, MTBE's have been determined to be a potential contaminant to aquifers and well water due to their ability to resist biodegradation. Also, MTBE's are possibly hazardous as a carcinogen. Ethanol is a possible alternative to MTBE's, but attracts water more aggressively than MTBE alcohol. As a result, the amount of water that may be drawn into Ethanol-blended fuels is increased.

Regardless of the strong attraction to water, Ethanol blended fuels as high as eighty-five percent Ethanol to fifteen percent gasoline (E-85 Fuel) are being investigated for use in the fuel dispensing industry. Although other benefits may exist, the objective of fuels such as E-85 is to provide a fuel that reduces atmospheric pollutions over that produced from hydrocarbon fuels and to reduce dependence on foreign oil.

To promote the use of Ethanol blended fuel, the auto industry has begun producing engines capable of using both regular gasoline fuel and E-85 fuel. Also, the fuel dispensing industry has developed fuel dispensers capable of dispensing E-85 without rusting or otherwise damaging the dispensers. However, improvements in filtration technology are needed to effectively remove water from alcohol-blended fuels such as E-85.

Due to the chemistry of alcohol, a certain amount of water can be dissolved in an alcohol-blended fuel (i.e., the alcohol bonds with the water) creating alcohol-water molecules. These alcohol-water molecules are heavier than other molecules in the blended fuel and gradually descend. The descent of alcohol-water molecules can cause an uneven distribution of alcohol within a fuel tank (e.g., the fuel in the lower portions of the tank eventually have a higher concentration of alcohol and water molecules). The uneven distribution of alcohol in an alcohol-blended fuel is referred to phase-separated fuel. Also, if the water reaches a maximum amount that the alcohol-blended fuel can dissolve, any additional water will separate from the blended fuel as phase-separated water and eventually settle at the bottom of the tank.

There are several problems that are caused by water. First, the creation of alcohol-water molecules degrades the performance of the blended fuel. Second, the heavier alcohol-water molecules cause an uneven concentration of alcohol in a blended fuel (i.e., phase-separate fuel) which causes lower burn temperatures (e.g., temperatures produced by a fuel containing less alcohol than expected) and higher burn temperatures (e.g., temperatures produced by a fuel containing more alcohol than expected). A lower burn temperature increases pollutants and a higher burn temperature is potentially damaging to engine parts. Third, phase-separated water acts as an abrasive causing damage to engine parts.

Existing water filters implement water-absorbing polymers having an anionic (negative) valence. These water-absorbing polymers attract and bond with the cationic (positive) valence of the water ($H_2O$) molecules that are passing through the water-absorbing media of the filter. However, in alcohol-blended fuels, the alcohol (due to its strong negative valence field) is repulsed by the negative valence field of the water-absorbing polymers. The combined influence of the covalent bond between alcohol-water molecules and the repulsion of the alcohol molecules from the water-absorbing polymers prevents current water-absorbing polymers from filtering (i.e., removing or retaining) water effectively.

Another problem with existing filters is that the water-absorbing polymers are derived from organic biomass such as cornstarch or cellulose with a methacrylic or other acid to form the water-absorbing polymers. The organic base of these water-absorbing polymers is subject to being degraded by bacteria and other microorganisms (i.e., life forms) that are normally found in water that is in gasoline or diesel storage tanks. The carbohydrate (starch) portion of these polymers acts as a food source that allows the life forms that are in water to proliferate within the filter. These life forms can disarm the filter's ability to remove water from fuel or to hold water that had previously been removed.

SUMMARY

In at least some embodiments, a filter comprises a filtering media. The filtering media is impregnated with chemical compounds that effectively retain water molecules and water-alcohol molecules but not alcohol molecules. The filter also comprises a liquid channeling structure, wherein the liquid channeling structure directs liquid entering an input of the filter to flow through the filtering media before exiting an output of the filter.

In at least some embodiments, the filtering media comprises a polymer backbone and monomer groups on the polymer backbone. The monomer groups exhibit a negative valence upon exposure to water and a positive valence upon exposure to alcohol, wherein water-alcohol molecules that are introduced to the water-filtering media bond with at least one negative valence monomer group and at least one positive valence monomer group. The monomer groups are selected from non-naturally occurring monomers that are resistant to biodegradation due to life-forms found in water.

The filters may be implemented in the form of spin-on filters, in-line filters or cartridge filters. Also, the filters may be implemented in fuel dispensing systems, vehicles or portable units to filter alcohol-blended fuels such as E-85. If the filter retains more than a threshold amount of water molecules or water-alcohol molecules, the filter prevents the flow of fuel. A user of the filter is able to monitor the amount of water being collected in a fuel tank by tracking how often a filter needs to be replaced. In this manner, a user can approximate when phase-separation of water in a fuel tank has occurred or will soon occur.

BRIEF DESCRIPTION OF THE DRAWINGS

For a detailed description of exemplary embodiments of the invention, reference will now be made to the accompanying drawings in which.

NOMENCLATURE

Certain terms are used throughout the following description and claims to refer to particular system components. As one skilled in the art will appreciate, filter companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . "

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims, unless otherwise specified. In addition, one skilled in the art will understand that the following description has broad application, and the discussion of any embodiment is meant only to be illustrative of that embodiment, and not intended to suggest that the scope of the disclosure, including the claims, is limited to that embodiment.

Figure 1:
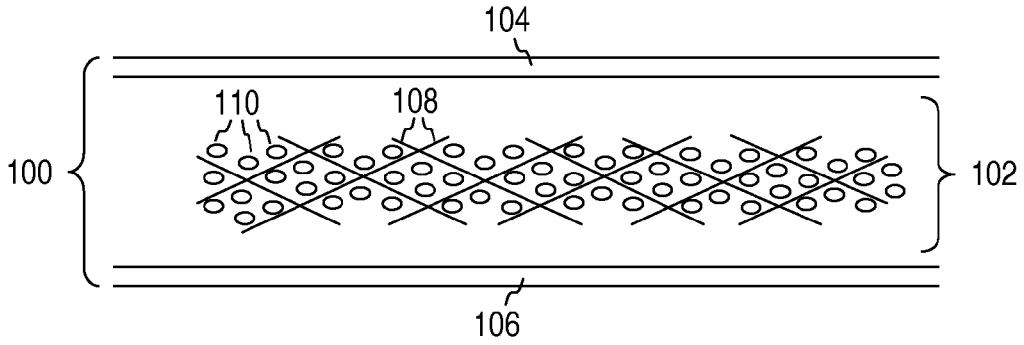
FIG. 1 illustrates a filtering media in accordance with embodiments of the invention.

Embodiments of the invention are intended to filter water from alcohol-blended fuels such as E-85. FIG. 1 illustrates a filtering media 100 (e.g., a laminated media) in accordance with embodiments of the invention. As shown in FIG. 1, the filtering media 100 comprises a water-absorbing structure 102 between a particle-removing medium 104 and another medium 106. The particle-removing medium 104 comprises a micro-glass or cellulose medium capable of filtering particles that range in size, for example, between 5 and 50 microns. Alternatively, the particle-removing medium 104 may comprise another particle-removing medium now known or later developed (e.g., a paper medium). The other medium 106 may comprise a layer of woven or non-woven material.

The water-absorbing structure 102 comprises a fiber-glass matting 108 that has been impregnated with a water-absorbing polymer 110. In at least some embodiments, the water-absorbing polymer 110 comprises a non-organic based crossed-linked polymer. For example, the water-absorbing polymer 110 may be based on synthetically-produced non-naturally occurring monomers. Because the water-absorbing polymer 110 does not contain organic constituents or carbohydrates, biodegradation from bacteria and microorganisms that are in water found in fuel storage tanks is avoided.

The constituents of the water-absorbing polymer 110 are chosen from non-naturally occurring monomers that exhibit a strong negative valence field on exposure to water and a less strong positive valence field on exposure to an alcohol. The valence of the water-absorbing polymer 110 is unique due to the selection of monomers of the polymerization formula. In at least some embodiments, the water-absorbing polymer 110 contains both cationic and anionic groups that are attached to the backbone of the polymeric structure. The magnetic fields exhibited by the cationic groups and the anionic groups facilitate the water-absorbing polymer's ability to encapsulate water even if the water is covalently bonded to alcohol groups of an alcohol-blended fuel such as E-85.

The cationic and anionic groups can be derived from non-organic groups that exhibit a negative charge upon exposure to water and a positive charge upon exposure to an alcohol. In at least some embodiments, the water-absorbing polymer 110 is derived from non-organic and non-naturally occurring monomers that are selected from carboxylate, sulfate, phosphate, sulfonates, phosphonates, propenoic acids, alpha-methyl-propenoic acids, beta-methyl-propenoic acids, polyacrylic acids, acrylic acids, maleic acids, fumaric acids, maleic anhydrides, fumaric anhydrides, alpha-ethylenically unsaturated mono-carboxycilic acids, beta-ethylenically unsaturated mono-carboxycilic acids, alpha-ethylenically unsaturated di-carboxycilic acids, beta-ethylenically unsaturated di-carboxycilic acids, alpha-ethylenically unsaturated mono-carboxycilic anhydrides, beta-ethylenically unsaturated mono-carboxycilic anhydrides, alpha-ethylenically unsaturated di-carboxycilic anhydrides and beta-ethylenically unsaturated di-carboxycilic anhydrides or any other non-organic monomer groups that yield an effective negative charge upon exposure to water and simultaneously yield an effective positive charge upon exposure to alcohol.

In at least some embodiments, the monomers of the water-absorbing polymer 110 comprise salts such as alkali ions, lithium ions, sodium ions, potassium ions. Additionally or alternatively, the monomers of the water-absorbing polymer 110 comprise earth metals such as magnesium ions, calcium ions, strontium ions, barium ions, zinc ions and aluminum ions. The polymer chemistry is selected to provide a crossed-linked water-absorbing polymer that is able to absorb water even if an alcohol is covalently bonded to the water.

Figure 2:
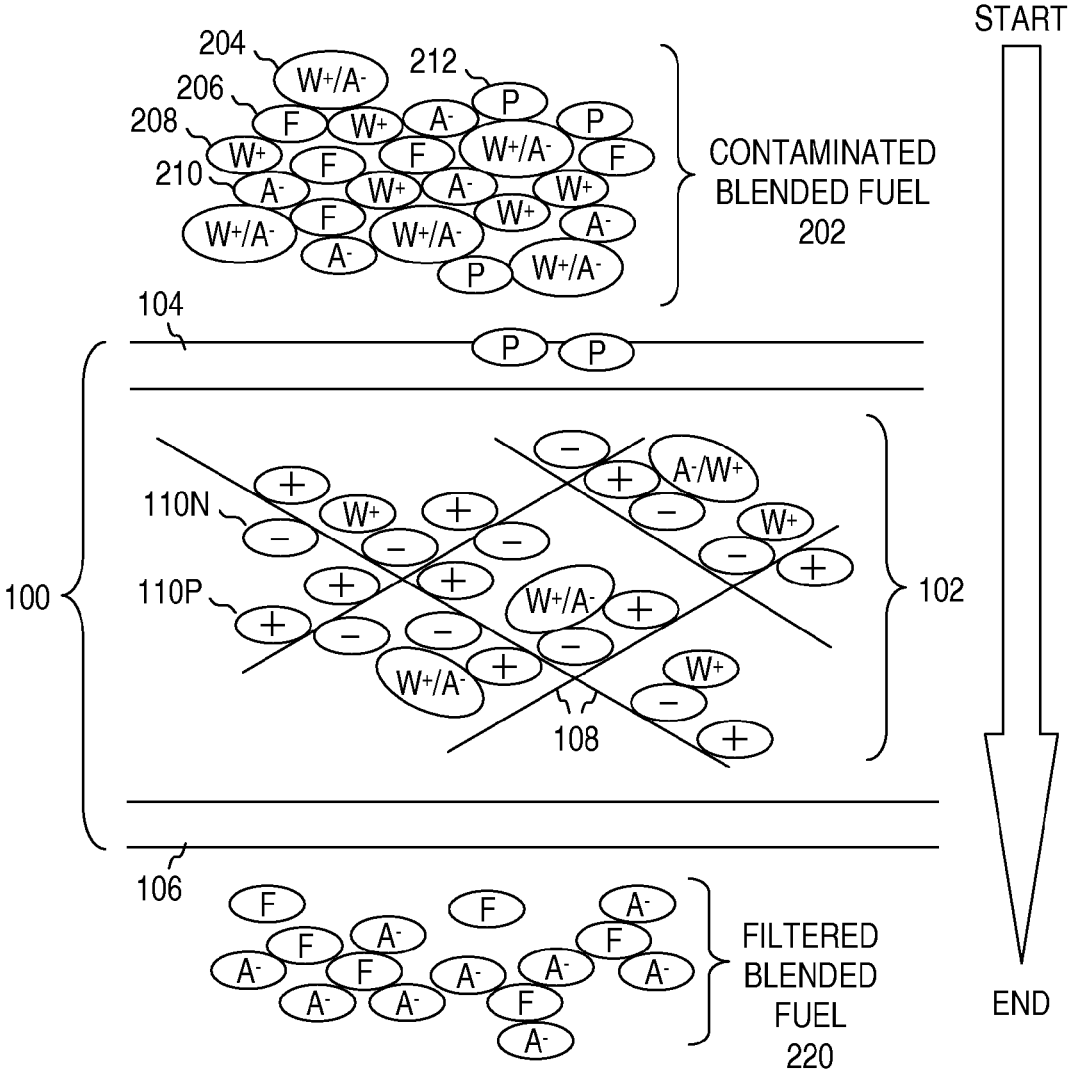
FIG. 2 illustrates using the filter media in accordance with embodiments of the invention.

FIG. 2 illustrates using the filtering media 100 in accordance with embodiments of the invention. As shown in FIG. 2, contaminated blended fuel 202 is introduced to the filtering media 100. The contaminated blended fuel 202 contains water-alcohol groups 204 (i.e., water covalently bonded to an alcohol), fuel groups 206 and alcohol groups 210. The contaminated blended fuel 202 also may contain water groups 208 (i.e., water that is not covalently bonded to an alcohol) and solid particles 212. The filtering media 100 removes the contaminants (e.g., water-alcohol groups 204, the water groups 208 and the particles groups 212) such that substantially only the fuel groups 206 and the alcohol groups 210 of the blended fuel are able to pass through the filtering media 100.

As the contaminated blended fuel 202 passes through the filtering media 100, the solid particles 212 are filtered by the particle-removing medium 104. Also, the water-alcohol groups 204 and the water groups 208 are filtered by the water-absorbing structure 102 which comprises both positive valence groups 110P and negative valence groups 110N.

In this filtering process, the water-alcohol groups 204 orient themselves and bond to at least one positive valence group 110P and at least one negative valence group 110N. For example, the water portion (which has a positive valence) of each water-alcohol group 204 is attracted to and bonds with at least one negative valence group 110N while the alcohol portion (which has a negative valence) of each water-alcohol group 204 is attracted to and bonds with at least one positive valence group 110N. Also, each water group 208 is bonded to at least one negative valence group 110N. In at least some embodiments, the negative valence field exhibited by each negative valence group 110N may be stronger than the positive valence field exhibited by each positive valence group 110P such that water groups 208 and water-alcohol groups 208 are effectively held by the water-absorbing structure 102. After passing through the filtering media 100, a filtered blended fuel 220 containing substantially only fuel groups 206 and alcohol groups 210 remains.

Figure 3:
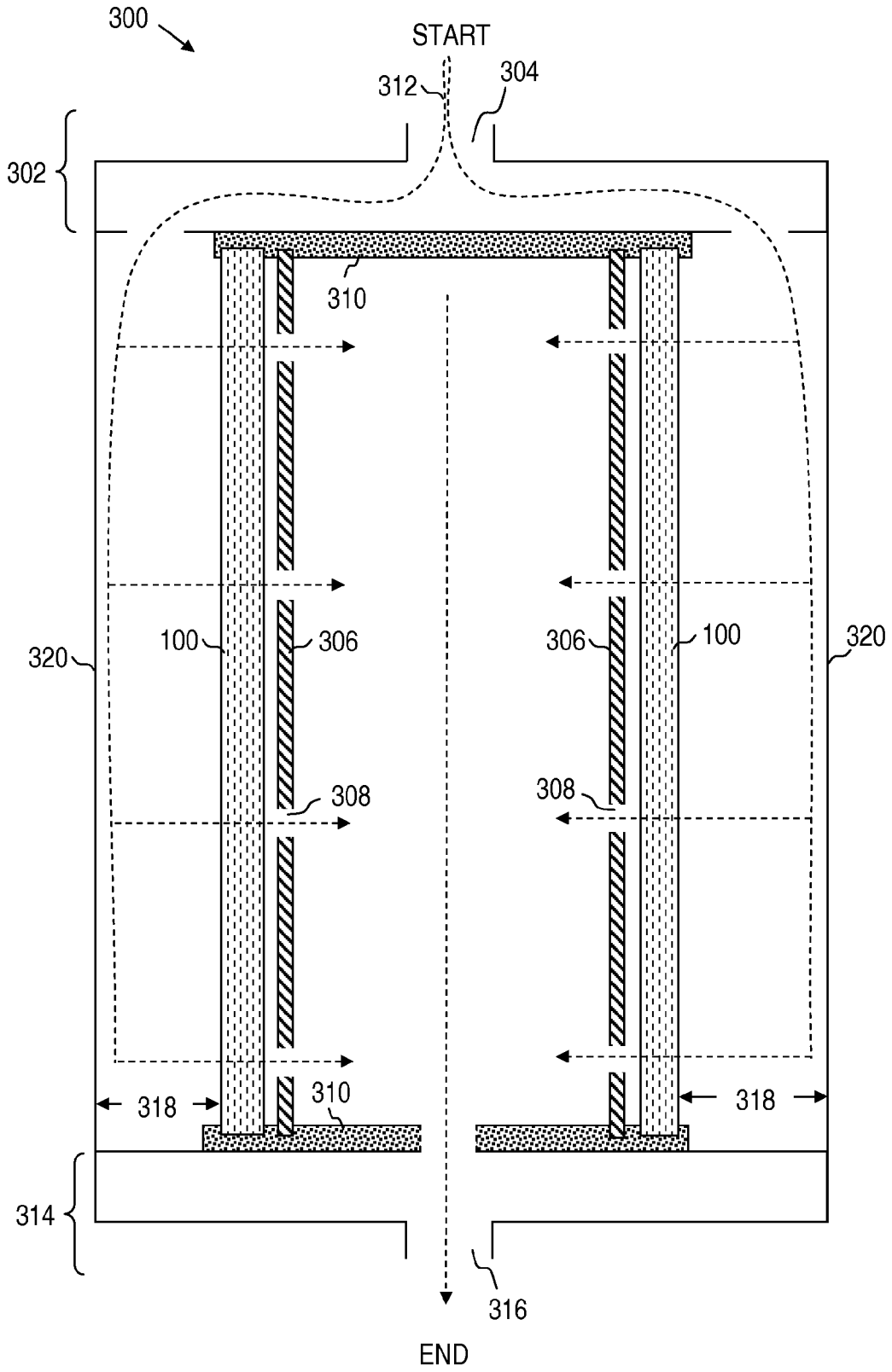
FIG. 3 illustrates a cross-section view of a filter in accordance with embodiments of the invention.

FIG. 3 illustrates a simplified cross-section view of a filter 300 in accordance with embodiments of the invention. As shown in FIG. 3, the filter 300 comprises two end caps 302 and 314 and an outer cover or sheath 320. The end cap 302 has an opening 304 that allows blended fuel to enter the filter 300 and the end cap 314 has an opening 316 that allows filtered blended fuel to exit the filter 300.

The filter 300 also comprises a center tube 306 having perforations 308. The center tube 306 is surrounded by the filtering media 100. In at least some embodiments, the filtering media 100 is pleated as will later be described. Both the center tube 306 and the filtering media 100 are secured to the end caps 302 and 314 using an adhesive 310 that is not solvated by water, alcohol, diesel or gasoline.

The dashed lines 312 illustrate the flow of a blended fuel such as E-85 through the filter 300. As shown, the blended fuel may enter through the opening 304 of the end cap 302. The blended fuel is forced to the outer perimeter of filter's inner chamber such that the blended fuel must pass through the filtering media 100. The filtering media 100 is configured to filter contaminants such as particles, water molecules and water-alcohol molecules. As the filtering media 100 retains water molecules and water-alcohol molecules, the filtering media 100 expands. Thus, space 318 is provided within the filter 300 to allow the filtering media 100 to expand. After passing though the filtering media 100, the blended fuel enters the inside of the center tube 306 via the perforations 308. The filtered blended fuel exits the filter 300 through the opening 316 of the end tube 314.

Embodiments of the invention are not limited to the filter 300 illustrated in FIG. 3. Rather, the filter 300 illustrates one of many possible embodiments that would force a blended fuel to pass through the filtering media 100 thereby filtering the blended fuel as desired. Various filter sizes such as 4"×5" and 7"×18" filters are intended. Also, various types of filters such as spin-on filters, inline filters and cartridge filters are intended.

Figure 4:
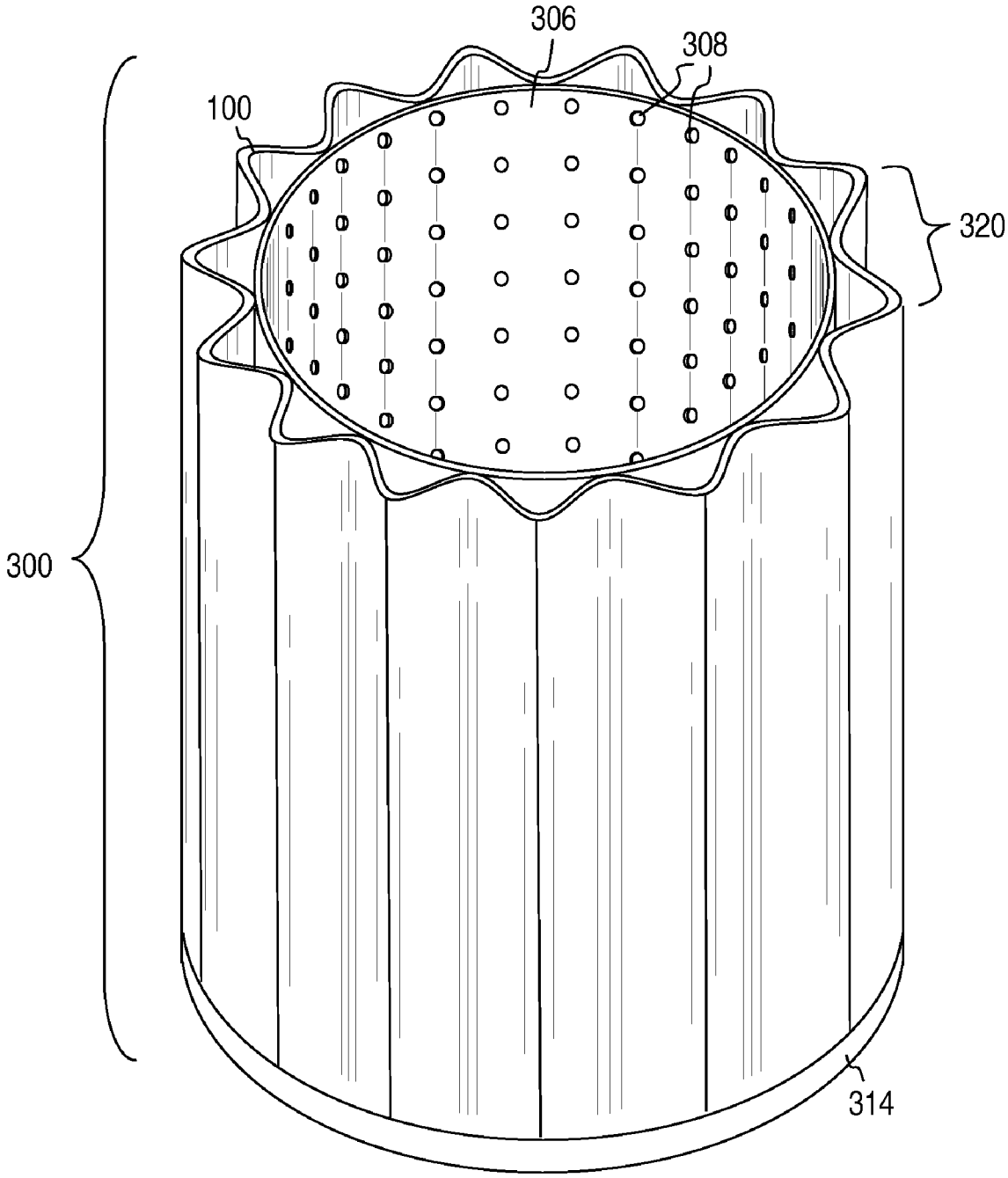
FIG. 4 illustrates a portion of the filter of FIG. 3 before filtering water in accordance with embodiments of the invention.

FIG. 4 illustrates a portion of the filter 300 before filtering water in accordance with embodiments of the invention. For convenience, the outer cover of the filter is not shown. As shown, the filter 300 comprises a center tube 306 having perforations 308. The center tube 306 is surrounded by the filtering media 100 in a pleated arrangement 320. Also shown is the end cap 314.

Figure 5:
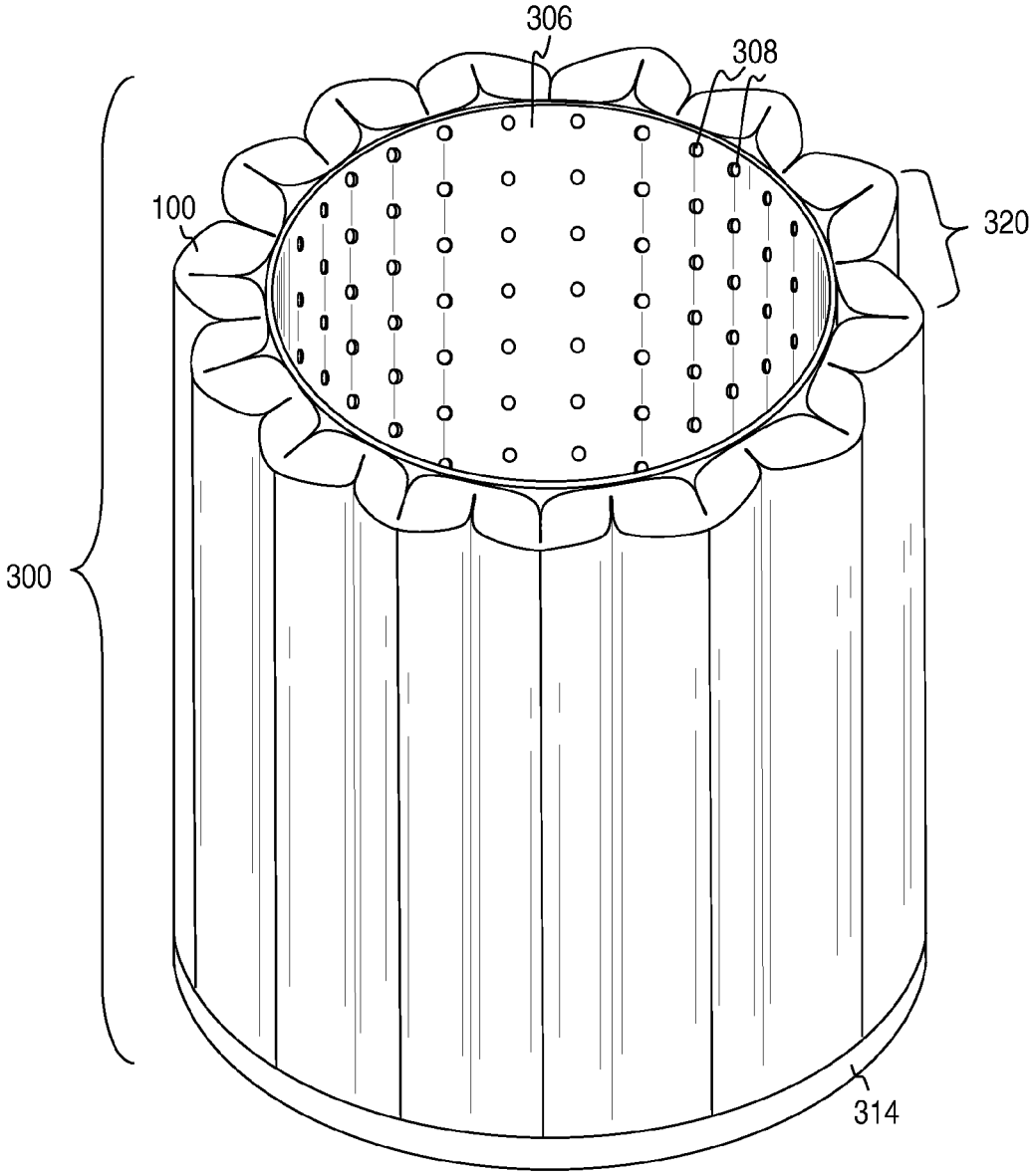
FIG. 5 illustrates a portion of the filter of FIG. 3 after filtering water in accordance with embodiments of the invention.

FIG. 5 illustrates a portion of the filter 300 after filtering water in accordance with embodiments of the invention. As shown, the pleats 320 of the filtering media 100 have swelled. Thus, as retention of water (both water molecules and water-alcohol molecules) occurs within the filtering media, the water-absorbing structure 102 shown in FIGS. 1 and 2 swells and presses against the particle-filtering medium 104 and the other medium 106 previously described. Because the mediums 104 and 106 are flexible, the swelling expands the pleats 320 to press against the inside chamber of the filter 300 (between the center tube 306 and the outer cover or sheath 320). By design, the filter 300 and the filtering media 100 enable water retention that is significantly greater than existing water-absorbing filters of comparable size. For example, a 4"×5" filter embodiment retains approximately 12 ounces of water and a 7"×18" filter embodiment retains approximately one gallon of water.

When the filter 300 absorbs a threshold amount of water (e.g., approximately 10 ounces for a 4"×5" filter), the pleats 320 press together with sufficient pressure to prevent fuel flow though the filter 300. In this manner, contaminated fuel is prevented from being dispensed to a vehicle or to a vehicle's engine. Also, by tracking the amount of filters that are used within a predetermined time period (e.g., if more than two filter are used within three months), a user is able to approximate if phase separation of fuel and/or phase-separation of water within a fuel tank is occurring or is about to occur. As previously explained, phase-separated fuel relates to an uneven distribution of alcohol in an alcohol-blended fuel (i.e., the fuel is separating from the alcohol or vice versa) and phase-separated water relates to water that is unable to be dissolved by an alcohol-blended fuel (e.g., water in excess of a threshold amount that is dissolvable in the alcohol-blended fuel becomes phase-separated water).

Figure 6:
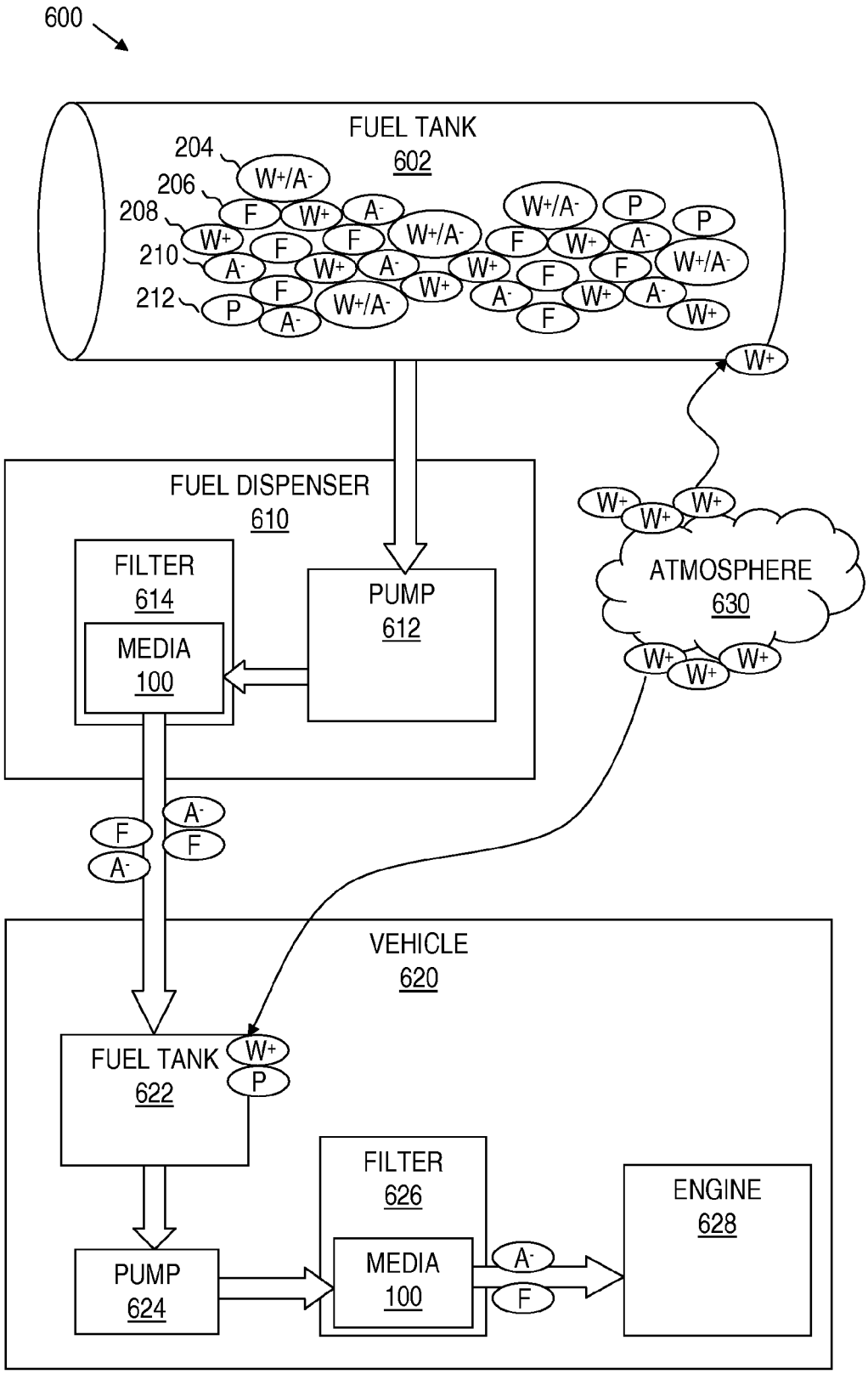
FIG. 6 illustrates a fuel dispensing system in accordance with embodiments of the invention.

FIG. 6 illustrates a fuel dispensing system 600 in accordance with embodiments of the invention. As shown in FIG. 6, the fuel dispensing system 600 comprises a fuel tank 602 and a fuel dispenser 610. The fuel dispenser 610 comprises a fuel pump 612 and a filter 614 that uses the filtering media 100.

The fuel tank 602 contains alcohol-blended fuel (i.e., alcohol molecules 210 blended with fuel molecules 206) such as E-85. As time passes, water molecules 208 and solid particles 212 may contaminate the alcohol-blended fuel. For example, water molecules 208 from the atmosphere 630 may be drawn to the alcohol molecules 210 in the fuel tank 602 creating water-alcohol molecules 204. Eventually, phase-separated fuel and phase-separated water can occur within the fuel tank 602.

When a vehicle 620 (e.g., a car, a truck or another vehicle having an engine) needs fuel, a user is able to fill a fuel tank 622 of the vehicle 620 by accessing the fuel dispenser 610. For example, the fuel tank 602 and the fuel dispenser 610 may be part of a service station that provides fuel to consumers. To ensure that the vehicle 620 receives uncontaminated fuel, the fuel dispenser 610 pumps the fuel from the fuel tank 602 through the filter 614. As previously described, the filtering media 100 of the filter 614 is able to filter solid particles 212, water molecules 208 and water-alcohol molecules 204. In at least some embodiments, the filtering occurs as the alcohol-blended fuel is pumped from the fuel dispenser 610 to the fuel tank 622 of the vehicle 620.

As time passes, water molecules 208 and solid particles 212 may contaminate the alcohol-blended fuel in the vehicle's fuel tank 622. For example, water molecules 208 from the atmosphere 630 may be drawn to the alcohol molecules 210 in the fuel tank 622 creating water-alcohol molecules 204. Eventually, phase-separated fuel and phase-separated water can occur within the fuel tank 622.

To prevent undesirable burn temperatures (caused by burning phase-separated fuel) and water-related damage to the engine 628, a filter 626 that uses the filtering media 100 is placed between the vehicle's fuel pump 624 and the engine 628. The filtering media 100 is able to filter solid particles 212, water molecules 208 and water-alcohol molecules 204 from the alcohol-blended fuel in the fuel tank 622. In at least some embodiments, the filtering occurs as the fuel pump 624 pumps the alcohol-blended fuel from the fuel tank 622 to the engine 628. In this manner, the engine 628 is able to burn uncontaminated fuel thereby improving fuel performance and reducing occurrences of engine damage caused high temperatures and/or water.

Embodiments of the invention are not limited to the fuel dispensing system 600 illustrated in FIG. 6. Rather, the system 600 illustrates that one or more filters which implement the filtering media 100 are able to effectively filter water and other particles from alcohol-blended fuel such as E-85. Such filters (e.g., the filters 614 and 624) may be implemented in the fuel dispenser 610 and/or in a vehicle 620 as shown. As previously described, the filtering media 100 is designed to be resistant to biodegradation caused by bacteria and other life-forms found in water. Thus, filters that implement the filtering media 100 are able to retain water for long periods of time without failure. In at least some embodiments, if a filter absorbs a threshold amount of the water (i.e., a maximum water capacity), the filter automatically stops the flow of fuel even against the force of a fuel pump (e.g., the pump 612 or 622). Thereafter, a new filter may be used to continue the filtering process. By tracking the amount of filters that are changed within a predetermined amount of time, it is possible for a user (i.e., filter operator) to approximate whether phase-separation of fuel or phase-separation of water has occurred or is about to occur.

Figure 7:
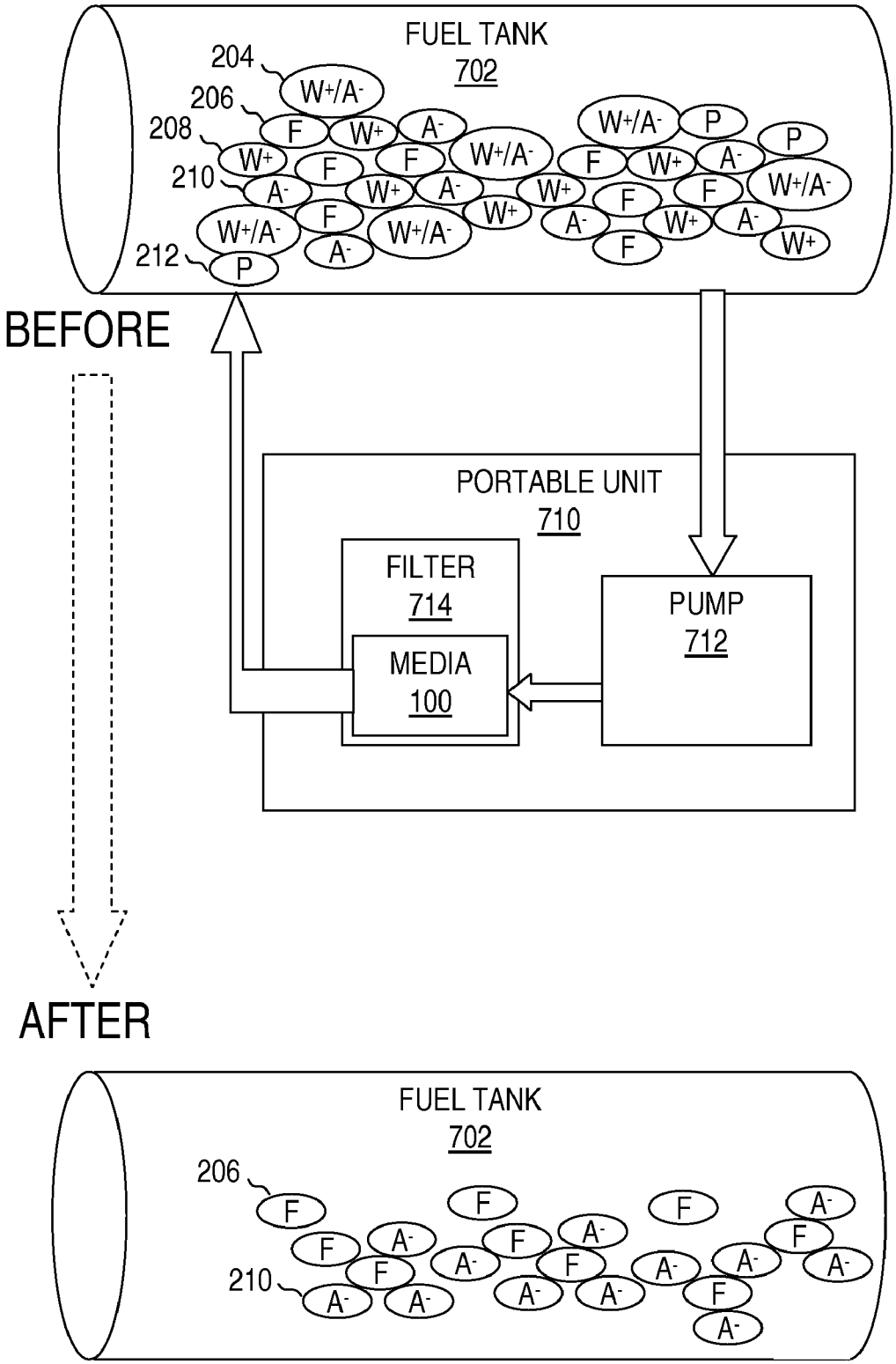
FIG. 7 illustrates a filtering process in accordance with alternative embodiments of the invention.

FIG. 7 illustrates a filtering process 700 in accordance with embodiments of the invention. As shown in FIG. 7, the filtering process 700 involves a portable unit 710 that connects to a fuel tank 702. The fuel tank 702 contains an alcohol-blended fuel such as E-85. The portable unit 710 comprises a pump 712 and a filter 714 that uses the filtering media 100.

In operation, the pump 712 of the portable unit 710 pumps the alcohol-blended fuel from the fuel tank 702 through the filter 714. The filtering media 100 is able to filter solid particles 212, water molecules 208 and water-alcohol molecules 204 from the alcohol-blended fuel. In some embodiments, the alcohol-blended fuel is returned to the fuel tank 702. In such embodiments, the portable unit 710 may operate for a predetermined amount of time. If the filter 714 reaches maximum water capacity during operation, the filter 714 stops the flow of fuel even against the pressure of the pump 712. An operator is then able to turn the pump 712 off, replace the filter 714, turn the pump 712 on and continue the filtering process. As shown, the filtering process 700 removes the contaminants from the alcohol-blended fuel.

Embodiments of the invention are not limited to the filtering process 700 illustrated in FIG. 7. For example, in alternative embodiments, the pump 712 is separate from the portable unit 710. Also, some embodiments may temporarily store the filtered fuel in a separate fuel tank until all the fuel and contaminants are emptied from the fuel tank 702. Thereafter, the filtered alcohol-blended fuel may be dispensed from the separate fuel tank or returned to the fuel tank 702.

In at least some embodiments, the filtering process 700 is used to prevent phase-separation of fuel or phase-separation of water. For example, if a filter (e.g., a the filter 614) of a fuel dispenser (e.g., the fuel dispenser 610) is replaced more than a threshold amount of times within a predetermined time period, the filtering process 700 may be used before phase-separation of fuel or phase-separation of water occurs within a fuel tank. Even if phase-separation of fuel or phase-separation of water has occurred within a fuel tank, the filtering process 700 may be used to remove the contaminant water on-site (the filter 714 may be replaced several times if needed). Thus, embodiments provide efficient and cost-effective solutions to filtering water from alcohol-blended fuels before or after phase-separation of fuel or phase-separation of water occurs.

Figure 8:
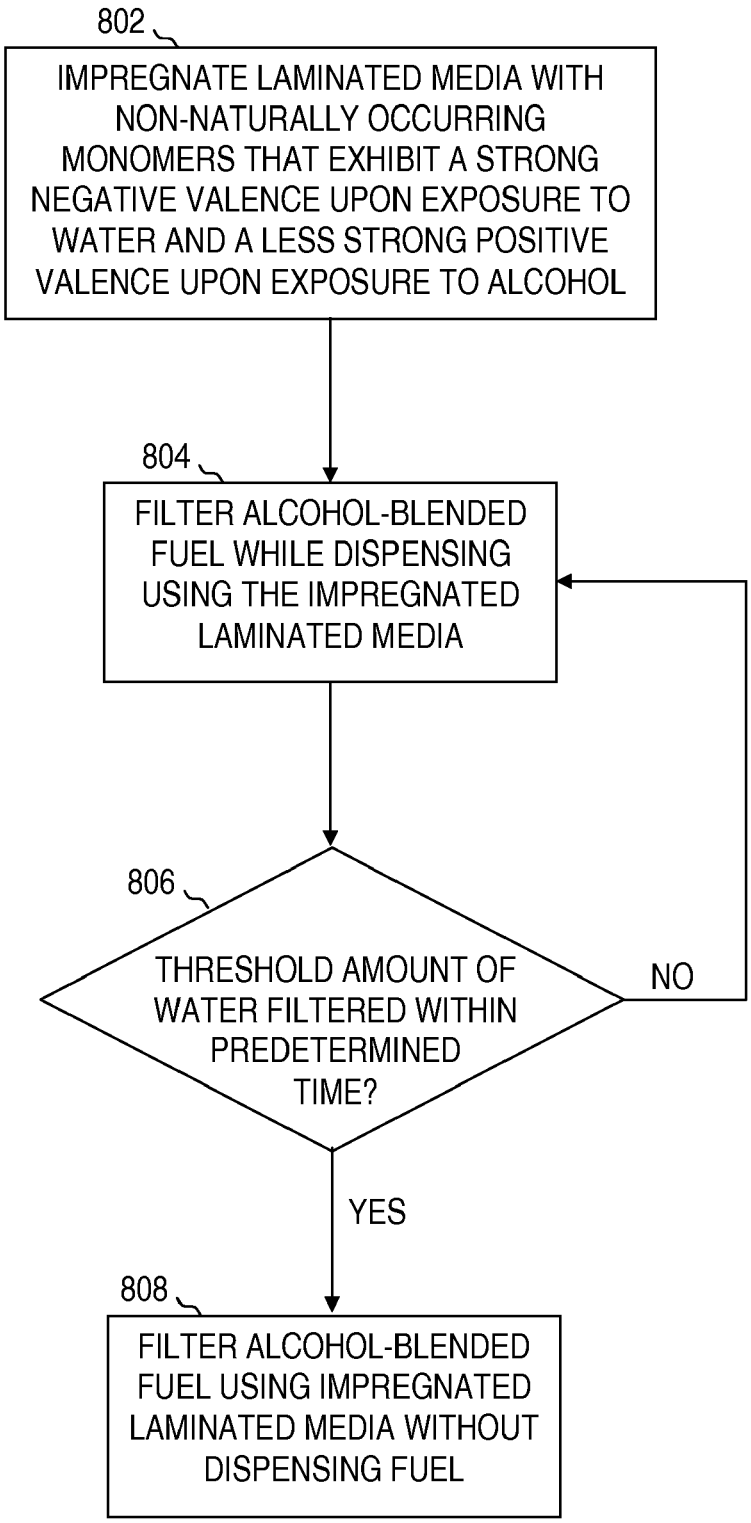
FIG. 8 illustrates a method in accordance with embodiments of the invention.

FIG. 8 illustrates a method 800 in accordance with embodiments of the invention. As shown in FIG. 8, the method 800 comprises impregnating a laminated media with non-naturally occurring monomers that exhibit a strong negative valence upon exposure to water and less strong positive valence upon exposure to alcohol (block 802). The method 800 further comprises filtering alcohol-blended fuel using the impregnated laminated media while dispensing the fuel (block 804). For example, the filtered alcohol-blended fuel may be dispensed from a bulk storage tank to the fuel tank of a vehicle or from a vehicle's fuel tank to the vehicle's engine. If a threshold amount of water is filtered within a predetermined amount of time (determination block 806), alcohol-blended fuel is filtered using the impregnated laminated media without dispensing the fuel (block 808). For example, a portable unit may be used to pump and filter contaminated fuel of a bulk storage tank without dispensing the fuel to a consumer or to the consumer's vehicle. If the fuel tank is part of a vehicle, a portable unit may pump and filter contaminated fuel of the vehicle's fuel tank without dispensing fuel to the engine. If a threshold amount of water is not filtered within a predetermined amount of time (determination block 806), alcohol-blended fuel is filtered using the impregnated laminated media while dispensing the fuel (block 804).

The above discussion is meant to be illustrative of the principles and various embodiments of the present invention. Numerous variations and modifications will become apparent to those skilled in the art once the above disclosure is fully appreciated. For example, the filtering media 100 and filters that implement the filtering media 100 may be used in other applications now known or later developed and are not limited to filtering alcohol-blended fuel intended for vehicles. Rather, the filtering media 100 and filters that implement the filtering media 100 are able to effectively filter water from alcohol and may be useful in any application that involves such a process. As an example, in the distillation process of producing alcohol, it is desirable that water not be present in the final alcohol product. Thus, filters containing the filtering media 100 can be used to remove the water. Also, filters containing the filtering media 100 are able to effectively remove water from non-blended fuels such as gasoline or diesel. It is intended that the following claims be interpreted to embrace all such variations and modifications.

What is claimed is:

1. A system for removing water-based contaminants from fluids, comprising:

a fluid inlet;

a fluid outlet;

a fluid pump between the fluid inlet and the fluid outlet; and a filter material between the fluid inlet and the fluid outlet, the filter material comprises a dual-valence polymer with negative valence monomer groups and positive valence monomer groups, the negative valence being stronger than the positive valence, wherein the fluid pump is configured to pump fluids from the fluid input to the fluid output through the filter material and wherein the dual-valence polymer of the filter material is configured to retain water-based contaminants of pumped fluids within the filter material, wherein the water-based contaminants comprise water molecules and water-bonded molecules.

2. The system of claim 1 wherein the filter material is positioned inside an enclosure.

3. The system of claim 2 wherein the enclosed filter material blocks fluid flow upon retaining a threshold amount of water-based contaminants.

4. The system of claim 1 wherein said fluids comprise hydrocarbon-based fluids.

5. The system of claim 1 wherein said fluids comprise alcohol-based fluids.

6. The system of claim 1 wherein said fluids comprise E-85 fuel.

7. The system of claim 1 being part of a service station fuel dispenser.

8. The system of claim 1 being part of a vehicle.

9. The system of claim 1 being part of a portable unit for filtering fuel tanks.

10. A method, comprising:

removing water-based contaminants from fluids by pumping the fluids through a filtering media having a dual-valence polymer with negative valence monomer groups and positive valence monomer groups, the negative valence being stronger than the positive valence, wherein the dual-valence polymer operates on said fluids to retain water-based contaminants within the filtering media; and outputting filtered fluids from said filtering media, wherein the water-based contaminants comprise water molecules and water-bonded molecules.

11. The method of claim 10 further comprising enclosing the filtering media within a canister.

12. The method of claim 11 further comprising detecting that the filtering media is blocking fluid flow upon retaining a threshold amount of water-based contaminants.

13. The method of claim 12 further comprising iteratively replacing used filtering media with new filtering media until fluid flow is not blocked even after a threshold amount of fluid has been pumped.

14. The method of claim 10 wherein said removing water-based contaminants from fluids comprises removing water molecules and water-bonded molecules from hydrocarbon-based fluids.

15. The method of claim 10 wherein said removing water-based contaminants from fluids comprises removing water molecules and water-bonded molecules from alcohol-based fluids.

16. The method of claim 10 wherein said removing water-based contaminants from fluids comprises removing water molecules and water-bonded molecules from E-85 fuel.

17. The method of claim 10 wherein said pumping is performed by a service station fuel dispenser.

18. The method of claim 10 wherein said pumping is performed by a vehicle.

19. The method of claim 10 wherein said pumping is performed by a portable fuel tank filter unit.

* * * * *